United States Patent [19]

O'Donnell

[11] Patent Number: 4,742,343

[45] Date of Patent: May 3, 1988

[54] DIGITAL STROKE GENERATOR

[76] Inventor: Ciaran O'Donnell, 11 rue Saint Christophe, 75015 Paris, France

[21] Appl. No.: 807,277

[22] Filed: Dec. 10, 1985

[30] Foreign Application Priority Data

Dec. 11, 1984 [FR] France ..... 84 18896

[51] Int. Cl.[4] ..... G09G 1/00

[52] U.S. Cl. ..... 340/739; 340/728; 340/740; 340/741; 340/750

[58] Field of Search ..... 340/739, 728, 740, 741, 340/749, 750, 747

[56] References Cited

U.S. PATENT DOCUMENTS

| | | | |
|---|---|---|---|
| 3,746,912 | 7/1973 | Redecker et al. | 340/743 |
| 3,938,130 | 2/1976 | Burnham et al. . | |
| 4,338,673 | 7/1982 | Brown | 340/739 |
| 4,384,286 | 5/1983 | DiToro | 340/743 |
| 4,507,656 | 3/1986 | Morey et al. | 340/739 |
| 4,529,978 | 7/1985 | Rupp | 340/739 |
| 4,633,243 | 12/1986 | Bresenham et al. | 340/739 |

OTHER PUBLICATIONS

J. Simmons, "Dynamic Vector Scaling Routine for Graphics Display", IBM Technical Disclosure Bulletin, 1978, vol. 21, No. 5, pp. 2050–2051.

*Primary Examiner*—John W. Caldwell, Sr.
*Assistant Examiner*—Mahmoud Fatahiyar
*Attorney, Agent, or Firm*—Cesari and McKenna

[57] ABSTRACT

A digital stroke generator reads and writes discrete stroke segments in a display memory. The generator comprises principally a line address register, a column address register, a command addresser, a counter and it may also include a data register. The command addresser which commands the incrementation and decrementation of the address registers comprises an octant register, a direction register in which the vector direction is memorized according to the ROTHMAN code and a transcoding matrix. The counter counts down the image points making up the vector to be drawn and blocks the processor when the count down is finished.

6 Claims, 3 Drawing Sheets

Figure 1:
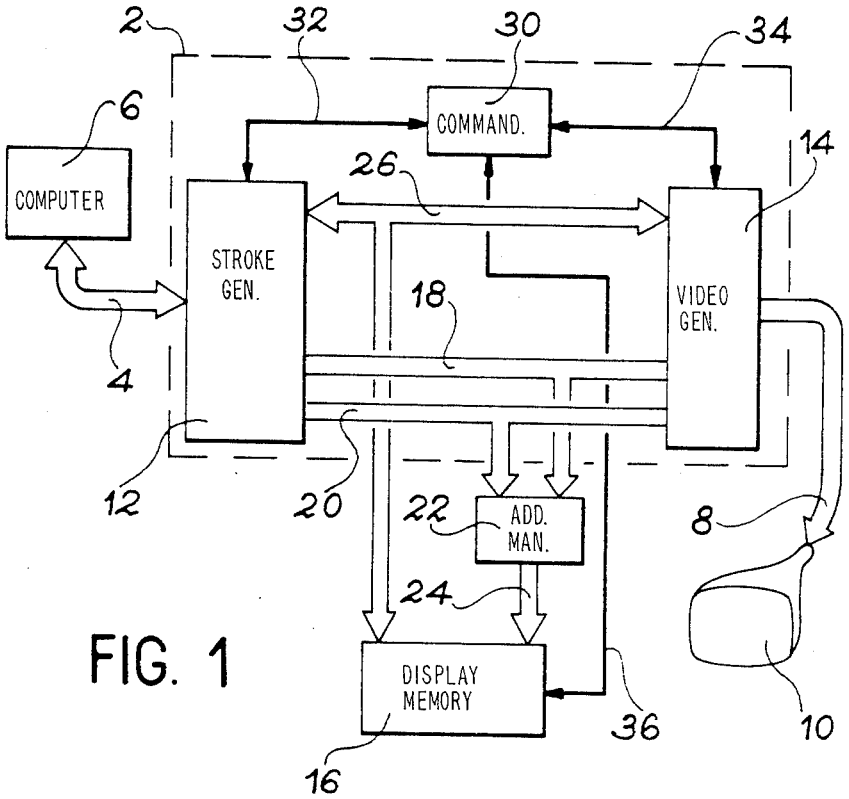
Figure 2A:
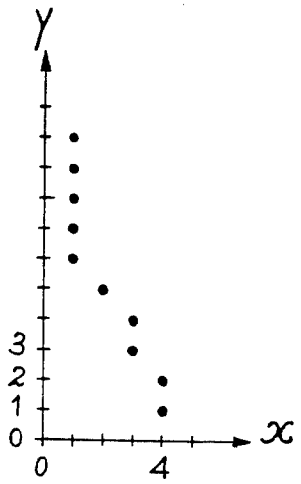
Figure 2B:
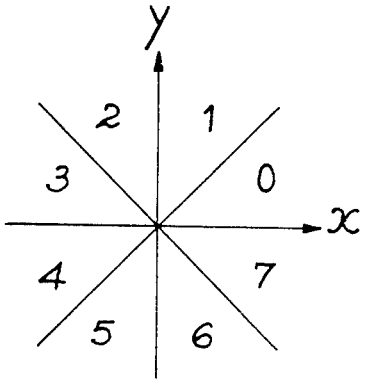

| | | RD = 1 | | RD = 0 | |
|---|---|---|---|---|---|
| | | X | Y | X | Y |
| 0 | 000 | INC X | INC Y | INC X | |
| 1 | 001 | | INC Y | INC X | INC Y |
| 2 | 010 | DEC X | INC Y | | INC Y |
| 3 | 011 | DEC X | | DEC X | INC Y |
| 4 | 100 | DEC X | DEC Y | DEC X | |
| 5 | 101 | | DEC Y | DEC X | DEC Y |
| 6 | 110 | INC X | DEC Y | | DEC Y |
| 7 | 111 | INC X | | INC X | DEC Y |

FIG. 4

DIGITAL STROKE GENERATOR

This invention relates to a digital stroke generator which reads and writes discrete segments in the display frame buffer of a computer system.

In information processing, the transmission of information from the computer to the user often uses a visual display terminal. The display capabilities of these terminals have been limited for a long time to alphanumeric and semigraphic characters.

For numerous applications such as computer aided design, these terminals are now being replaced by graphic terminals with a resolution of 256×256 points or more. These terminals are particularly useful in applications where information can be respresented advantageously by an image, such as in medicine, map drawing, weather forecasting, pattern recognition, etc.

The fundamental elements of a graphics terminal are: a memory frame buffer, a graphics processor, and a display monitor. The graphics processor or graphics screen controller contains a processing element for image memory update as a function of data received from the computer system, a video generator providing a video signal corresponding to the content of the display memory and an access controller to arbitrate memory access between the processing element and the video generator.

Existing graphics processors are implemented in NMOS integrated circuit technology. This represents a limitation in that the maximum display resolution is on the order of 1024×1024 points. For higher resolution images, the required frame buffer bandwidth for the display monitor requires using the fastest available TTL components (FAST) and for images of more than 2000×2000 resolution, the ues of ECL technology to implement the video serializer becomes mandatory.

Thus, the use of NMOS graphics display controllers implies that acess to the display memory is almost totally consumed by the video generator as soon as image resolution becomes significant. This limits the speed of memory update by the processing element whose access to the frame buffer is almost totally reduced to the video horizontal synchro return time. This implies that maximum memory write time is only on the order of $10^6$ points/sec.

It would seem more judicious, considering the very important difference between the bandwidth requirements of the video generator and the processing element, to separate these two elements and implement, for instance, the video generator in ECL technology, and the processing element in NMOS.

This would reduce the constraints on the access of the processing element to the display memory without imposing an important cost increase for the grahics processor. In particular, certain configurations of the video generator could allow an access to the display processor to the frame buffer, not only during the horizontal synchro return, but also one or more timer per display line.

This invention relates to a digital stroke generator, or processing element, implemented separately from the video generator. The originality of the digital stroke generator of this invention lies in a particular architecture, based on a known representation of the discrete segment to be drawn. This architecture allows a very high memory update time of up to, for example, $5\times10^6$ points/second during the horizontal synchro return and in the absence of display memory refresh. This performance figure is given as an example; clearly actual performance depends on the type of memory used, and more particularly, on the type of memory access (read-write or read-modify-write), as well as the presence or absence of display refresh.

Specifically, this invention relates to a digital stroke generator to read and write discrete segments in a display memory organized in lines and columns, each such discrete segment being defined by origin coordinates, a direction, and a length, the digital stroke generator comprising:

- a line address register and a column address register, these two registers containing up/down counter inputs,
- an address command means comprising an octant register and a direction register, this address command means delivering command signal inputs to the address registers,
- a means of counting,
- a clock delivering a synchronization signal to the above registers and command means, such clock receiving from the counting means a validation signal when the content of the counter is different from a predetermined value, and
- an interface circuit coupled to the said registers and command means to initialize the address registers with the coordinates of the vector origin, the octant register with the octant of the vector direction, the direction register with the canonical form of the discrete line segment acording to the ROTHMAN code and the counting means with the vector length.

The use of the ROTHMAN code to indicate the elementary points constituting the discrete line segment to be drawn allows the possibility to drawn not only straight line segments, but also all other forms of curves, circles, characters, etc. The processing element of this invention is more flexible in this regard than the known graphics processors whose digital stroke generation is based on the BRESENHAM method useful primarily for straight line segments.

According to another preferred embodiment, the digital stroke generator of this invention comprises a data register with parallel inputs and serial inputs. In this case, data register is initially loaded by the interface circuit with the state of the elementary points of the discrete segment, the output of such register being coupled to the data input of the display memory. The clock means synchronizes the output from the data register.

According to another preferred embodiment, the data register also contains a serial input coupled to the data output of the display memory and a parallel output coupled to the interface circuit. This structure allows the digital stroke generator to simultaneously read and write a vector. This, in turn, permits the selective erasure of a part of an image drawn previously. It is in effect sufficient during the drawing of a line segment in the display memory to read and save the segment memorized which is then replaced by the said segment written in display memory. To later erase the said vector written, it is only necessary to rewrite the saved vector.

This possibility of selective erasure does not exist in known graphics processors which only implement the write operation of a discrete segment and which cannot read a vector from display memory.

According to another preferred embodiment, for a display memory with n parallel planes, where n is an integer, the processing element comprises n data registers, each data register being associated with an image plane.

According to another preferred embodiment, the counting means is a down-counter, the said down-counter providing a validation signal to the clock as long as its content is different from zero.

According to another preferred embodiment, the address command means contains a transcription matrix with four inputs and four ouptuts, the outputs being coupled to the up/down inputs of the address registers, three inputs being coupled to the octant register and the fourth to the direction register.

Figure 3:
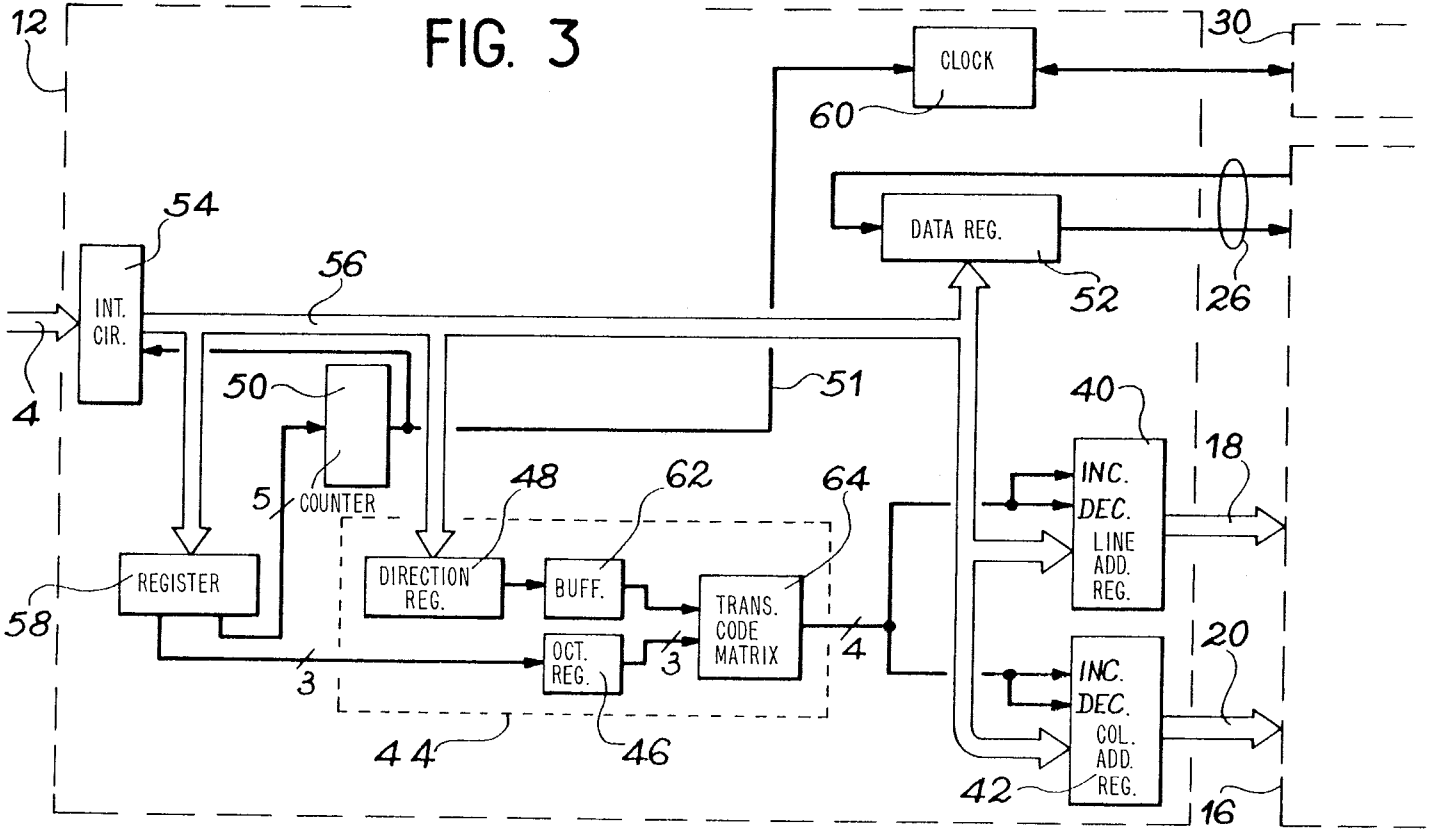

The characteristics and advantages of the invention will become more clear from the description hereinafter relative to non-limitative embodiments, and with a reference to the annexed drawings, wherein show:

FIG. 1 illustrates schematically a computer system comprising a graphics processor for the display of a numeric image on a display monitor, the said graphics processor containing a digital stroke generator according to the invention, FIGS. *2a* and *2b* represent the numerised form of a vector on a display monitor and the decomposition in octants of the possible directions of a discrete line segment in the plane of the display monitor, FIG. 3 represents schematically an embodiment of the digital stroke generator of the invention, and FIG. 4 illustrates the up/down address commands in function of the octant register and the content of the direction register.

The FIG. 1 represents a visualization terminal containing a graphics processor 2 coupled by a duplex line 4 to a computer 6 and coupled by a link 8 to a monitor 10. The duplex link 4 comprises an address bus, a data bus, and command lines to manage the transmission between the computer 6 and the graphics processor 2.

The graphics processor 2 comprises principally a digital stroke generator 12 made according to this invention, a video generator 14, and a command means 30. It is coupled to a display memory 16.

This display memory 16 is organized in lines and columns. It can comprise one or several parallel planes, each plane containing one bit per pixel. This memory is accessed by the generator 12 and the video generator 14 by two address buses 18, 20 used to designate the X and Y coordinates of a pixel, respectively. An address management means 22, coupled to the memory 16 by an address bus 24, translates the said X and Y coordinates to a physical address.

Data transfer between the generator 12 and the video generator 14 and the memory 16 passes through a bidirectional data bus 26. The generator 12 can thus read or write a vector in the display memory 16.

The command means 30 of the graphics processor is coupled by a first bidirectional link 32 to the digital stroke generator 12 and by a second bidirectional link 34 to the video generator 14. By these links, the command means 30 receives the access requests to the memory 16 from the generator 12 and the generator 14 and it replies with handshake or ready signals when the memory access is allowed. In case of conflict between the processor 12 and the video generator 14, the command means 30 gives access to the video generator.

The command means 30 is also coupled to the memory 16 by a link 36 which allows to indicate the type of access to the memory read, write, clear, etc.

The image memory 16 is preferably a dynamic memory functioning in "nibble" mode to accelerate the read accesses. This mode consists in reading several successive addresses in one access cycle. These words are written in a buffer register of the video generator 14. This buffer register renders the memory read by the video generator 14 asynchronous with the video output. Thus, it allows interleaving an access to the memory 16 between two accesses by the video generator.

The generator 12 can thus make several accesses to the display memory 16 per screen line. For example, for an image containing 1728 points per line organized in 64 bit words, a screen line contains 27 words. If each access in nibble mode allows reading 4 words 7 accesses suffice to read a screen line. The digital stroke generator 12 can thus access the display memory 16 not only during the horizontal snychro return, but also several times per image line. This permits high speed vector drawing in the memory 16 by the generator 12.

The particular structure of the digital stroke generator 12 of this invention also contributes to high speed vector drawing in the memory. We will describe in FIG. 3 a detailed embodiment of the generator 12. However, we will first indicate the form in which a vector is memorized in the generator 12.

A vector is defined by several parametes which can be its origin coordinates X and Y, a direction, a length, and possibly the state (gray level) of each pixel making up the vector. For example, we have represented in FIG. *2a*, a vector whose original X-Y coordinates are 4.1, length 10. The direction is obtained by combining an octant number and the decomposition of the vector according to the ROTHMAN code.

The octant number associated with a vector corresponds to the sector of 2-space containing the direction of this vector. This decomposition in sectors is represented on the FIG. *2b*. The octant associated with the vector represented in FIG. *2a* is the octant 2. This decomposition in octants is known in the state of the art. It simplifies the drawing of a discrete segment, because this can always be reduced to a base octant, typically the octant 10, by symmetries around the X and Y axes. The drawing of an arbitrary vector reduced to the base octant can be implemented very rapidly by known algorithms such as the BRESENHAM algorithm.

The octant defines the general direction of the vector. The ROTHMAN decomposition then defines the relative position of two consecutive points of the vector. This code consists in associating a first value when one passes in the base octant to the following point by a horizontal displacement by incrementation of the X coordinate, and a second value if one passes from a vector point to the following point by a diagonal displacement by incrementation of both the X and Y coordinates.

For example, if one indicates the first value as "0" and the second value as "1", the vector represented on the FIG. *2a* has, upon decomposition, the sequence 0 1 0 1 1 0 0 0 0.

The digital stroke generator 12 comprises principally:

a line address register 40 which delivers on the address bus 18 the pixel X coordinate, the said register containing an input INC to command an incrementation and an input DEC to command the decrementation of its contents, a column address register 42 delivering on the address bus 20 the pixel Y coordinate, the said register containing equally an input INC of command of incrementation of its value and an input DEC of command of decrementation of its value, an address command means 44 containing an octant register 46 and a direction register 48 to memorize the direction of the vector to be written in memory according to the ROTHMAN code, and a counting means 50 to memorize the length of the vector to be drawn.

The address registers 40 and 42 and the octant register 46 are buffers with parallel inputs and outputs. The direction register 48 is a register with parallel inputs and serial outputs.

In the embodiment represented on the FIG. 3, the digital stroke generator 12 comprises also a data register 52. This register permits the inscription in memory of a vector containing an arbitrary bit sequence, thus facilitating the inscription in memory of discontinuous vectors (dashed and dot-dashed lines).

The data register 52 is associated with a memory in which a bit is associated with a pixel, that is to say, in which the image in memory is bilevel. In the case where n bits are associated with a pixel, the memory may be constituted advantageously of n parallel planes, each plane memorizing one bit of the pixel. In the case of this multi-plane memory, the address registers and the command address register remain unique.

The data register 52 is preferably a shift register with independent parallel and serial inputs and outputs such as the circuit 54AS877 of TEXAS INSTRUMENTS. The serial input and output are used for read and write data transfer with the display memory 16. The parallel input and output serve for the data transfer to the computer system to which the graphics processor is coupled.

In the case where the data register 52 is omitted, the generation of a digital stroke in the display memory consists in forcing the value of the binary elements of memory corresponding to vector points to a predetermined value.

The stroke generation can also be implemented using an operator, for instance, an Exclusive-OR circuit of which one input receives the value of te binary elements of memory corresponding to the vector points, the other input receiving, either a predetermined value, or data delivered from the data register 52 and whose output, coupled to the display memory, delivers the effective value of the vector points to be written in memory.

The different registers of the digital stroke generator 12 are loaded with data received from a computer by the bidirectional bus 4. An inteface circuit receives said data and the command signals of the computer and delivers these data on an internal bus 56 of the generator 12. The interface circuit 54 can also contain, in particular, an input FIFO buffer to memorize several commands or data received from the computer as well as the means to select the different registers of the generator 12.

The address command means 14 receives from the interface circuit 54 a word representing the canonical form of the vector to be written according to the ROTHMAN code, this mode being memorized in the direction register 48. Means 44 also receives from circuit 54 the octant number which is memorized in the octant register 46.

In the embodiment represented in the FIG. 3, a vector to be drawn is decomposed in 32 bit segments. An 8 bit word can thus indicate simultaneously the length of the segment and the octant in which the vector is contained. This word is received by the interface circuit 54 and memorized in a buffer register 58. The 5 bits corresponding to the segment length are next loaded into the counting means 50 and the 3 bits corresponding to the octant number are loaded into the octant register 46.

The counting means 50 is a down counter. Its content is decremented in synchronization with the clock 60. This clock 60 is coupled in a classical manner to the different elements of the digital stroke generator 12 and serves to synchronize the data handling by the different processor elements.

The clock signals are delivered upon reception of a validation signal delivered by the command means 30 and they are blocked by a signal received from the down counter. Since this type of chronization is well known in the art, we have not considered it useful to show the conductors that bring the clock signals to the elements of the digital stroke generator 12.

When, following a decrementation, the contents of the counting means 50 becmes zero, the counter applies to the line 51 a signal to the clock 60 to stop the emission of address and data signals to the display memory. This signal, or a derived signal, can also be applied to the interface circuit 54 to signify to the computer that the vector segment has been drawn.

We will now explain the operation of the digital stroke generator 12. Initially, the interface circuit 54 loads the address registers 40 and 42 with the origin coordinates of the segment, the data register 52 with the value to be written in memory, the direction register 48 with the canonical form of the vector according to the ROTHMAN code, and the register 58 with the segment length to be written and the octant number corresponding to the direction of this segment.

The passage from one point of the image to another is obtained firstly by commanding a shift of the content of the data register 52 and secondly by modifying the contents of the registers 40 and 42 as a function of the contents of the direction register 48 and the octant number contianed in the register 46. To realize this update, the address command means 44 contains a buffer 62 to memorize the bit delivered from the data register 48 consecutive to the shift and a transcoding matrix 64 with 4 inputs and 4 outputs. The inputs to this matrix are coupled to the output of the buffer 62 and the three outputs of the octant register 46. The outputs of matrix 64 are coupled to the incrementation and decrementation command inputs of the address registers 40 and 42 respectively.

We have represented on the FIG. 4 the truth table of this matrix. In this table, we have indicated respectively the octant number, the corresponding binary code, the value of the RD bit contained inthe buffer 62 and the corresponding action on the contents of the address registers 40 and 42.

I claim:

1. A digital stroke generator for writing a vector in a display memory, said display memory being organized in lines and columns and having a line address input, a column adress input and data input-output, wherein said digital stroke generator comprises:

A. a data bus for transmitting data in the digital stroke generator;

B. an interface circuit having a data input for receiving from remote equipment line and column coordinates data defining the origin coordinates of said vector, octant data defining the general direction of said vector, length data defining the number of pixels of said vector, and Rothman coded data defining the shape of the vector, said interface circuit also having a data output connected to said data bus;

C. a line address register having an incrementation control input, a decrementation control input, a data input connected to said data bus for receiving said line coordinate data, and a data output connected to said line address input of said display memory;

D. a column address register having an incrementation control input, a decrementation control input, a data input connected to said data bus for receiving said column coordinate data and a data output connected to said column address input of said display memory;

E. address control means connected to said data bus and comprising an octant register for receiving said octant data and a direction register for receiving said Rothman coded data, said address control means combining said octant data and said Rothman coded data to supply control signals to the incrementation and decrementation control inputs of said line and column address registers;

F. counting means receiving said length data and supplying a validation signal when the value of said counting means is different from a predetermined value; and G. clock signal means receiving said validation signal and supplying synchronization signals to synchronize said line address register, said column address register, said address control means and said counting means.

2. A digital stroke generator according to claim 1 and further including a data register receiving from said interface circuit a sequence of data representing the binary value of each pixel of said vector, said data register being clocked by said clock signal means for supplying said binary values to the data input-output of said memory.

3. A digital stroke generator according to claim 2 wherein said data register comprises a serial input-output connected to said input-output of said display memory and a parallel input-output connected to said interface circuit.

4. A digital stroke generator according to claim 2, for a display memory comprising n parallel memory planes, wherein said digital stroke generator comprises n data registers each of which is associated with a different image plane.

5. A digital stroke generator according to claim 2 wherein said counting means include a down-counter, said down-counter supplying said validation signal as long as its content value is different from zero.

6. A digital stroke generator according to claim 2 wherein the address control means further comprise a transcoding matrix receiving the octant data from said octant register and serially receiving said sequence of data from said data register, and supplying control signals to said incrementation and decrementation inputs of said line and column address registers to set the address of the successive pixels of the vector.

* * * * *